US010881255B2

(12) United States Patent
Cominotti et al.

(10) Patent No.: US 10,881,255 B2
(45) Date of Patent: Jan. 5, 2021

(54) CUSHIONED COUPLING HINGE AND A TOILET SEAT COMPRISING SUCH A CUSHIONED COUPLING HINGE

(71) Applicant: COMINOTTI S.R.L., Brescia (IT)

(72) Inventors: Michele Cominotti, Brescia (IT); Arduino Antonio Donati, Brescia (IT)

(73) Assignee: COMINOTTI S.R.L., Brescia (IT)

( * ) Notice: Subject to any disclaimer, the term of this patent is extended or adjusted under 35 U.S.C. 154(b) by 45 days.

(21) Appl. No.: 16/333,747

(22) PCT Filed: Sep. 7, 2017

(86) PCT No.: PCT/IB2017/055387
§ 371 (c)(1),
(2) Date: Mar. 15, 2019

(87) PCT Pub. No.: WO2018/055476
PCT Pub. Date: Mar. 29, 2018

(65) Prior Publication Data

US 2019/0357738 A1 Nov. 28, 2019

(30) Foreign Application Priority Data

Sep. 26, 2016 (IT) ..... 102016000096321

(51) Int. Cl.
*A47K 13/12* (2006.01)

(52) U.S. Cl.
CPC ..... *A47K 13/12* (2013.01)

(58) Field of Classification Search
CPC ..... A47K 13/12
USPC ..... 4/240
See application file for complete search history.

(56) References Cited

U.S. PATENT DOCUMENTS

2010/0162476 A1* 7/2010 Cavagna ..... A47K 13/12 4/236
2012/0284909 A1* 11/2012 Chen ..... A47K 13/12 4/240
2013/0333104 A1* 12/2013 Hong ..... A47K 13/12 4/236

(Continued)

FOREIGN PATENT DOCUMENTS

CN 103622632 A 3/2014
DE 102006020205 A1 11/2007

(Continued)

*Primary Examiner* — Huyen D Le
(74) *Attorney, Agent, or Firm* — Arent Fox LLP; Michael Fainberg

(57) ABSTRACT

The invention therefore relates to a cushioned coupling hinge 1 suitable to rotatably couple the seat-ring 71 and the lid 72 of a toilet seat to a toilet 70. The hinge 1 comprises a cushioning mechanism suitable to cushion the falling movement of the mobile component during rotation around the axis of rotation X; a mobile portion 20 integrally constrainable to the seat-ring or lid in rotation; a fixed portion 30 integrally constrainable with the toilet 70. Advantageously, both the maintenance in position of the hinge along the axis of rotation and the actuation of the cushioning mechanism is obtained by means of a single engagement element 4 inserted at right angles to the axis of rotation simultaneously through the seat-ring/lid to be cushioned and the mobile portion 20.

12 Claims, 8 Drawing Sheets

(56) References Cited

U.S. PATENT DOCUMENTS

| | | | | |
|---|---|---|---|---|
| 2015/0216379 | A1* | 8/2015 | Chen | A47K 13/12 4/240 |
| 2015/0265110 | A1* | 9/2015 | Chen | A47K 13/26 4/240 |

FOREIGN PATENT DOCUMENTS

| | | | |
|---|---|---|---|
| WO | 201209230 | A2 | 7/2012 |
| WO | 2015001445 | A1 | 1/2015 |

* cited by examiner

CUSHIONED COUPLING HINGE AND A TOILET SEAT COMPRISING SUCH A CUSHIONED COUPLING HINGE

CROSS-REFERENCE TO RELATED APPLICATIONS

This application is the U.S. National Stage Application of International Patent Application No. PCT/IB2017/055387, filed on Sep. 7, 2017, which claims priority to Italian Patent Application No. 102016000096321, filed on Sep. 26, 2016, the contents of each of which is incorporated herein by reference in its entirety.

FIELD OF INVENTION

The object of the present invention is a cushioned coupling hinge for a seat-ring or lid of a toilet.

BACKGROUND OF THE INVENTION

In the sanitary sector, coupling hinges are used to hinge the seat-ring and the closing lid to the bowl part of a toilet. These hinges allow a rotation of the seat-ring/lid with respect to the bowl from a horizontal closure position, resting on the rim of the bowl, to a substantially vertical opening position, wherein the seat-ring/lid is open about 110 degrees and usually leaning against the wall upon which the toilet is installed.

In order to prevent the seat-ring/lid from falling onto the bowl, with the risk of damage to the ceramic or damage to the seat-ring/lid, it is known to use cushioned hinges that cushion the fall of the seat-ring/lid, easing the descent of the seat-ring/lid to rest on the rim of the bowl.

The known hinges consist of a number of components, including cushioning means for cushioning the fall of the seat-ring/lid, adapters for connecting the hinge and the ceramic toilet, connecting elements for connecting the cushioning means with the adapters, spring clips to prevent the accidental dislodging of the hinge from the seat provided inside the seat-ring and the lid to be cushioned: all are elements that make the hinges complex from the construction and installation point of view, as well as cumbersome and of considerable size.

Furthermore, in known hinges, the cushioning means are mechanically engaged inside the seat-ring or lid by means of teeth. This makes the manufacturing process complex and expensive, as the teeth must be accurately made on each component (hinge, seat-ring and lid) in the molding stage, and it does not allow interchangeability of the hinges.

SUMMARY OF THE INVENTION

The object of the present invention is to provide a coupling hinge which is particularly compact and effective in the cushioning action.

Such object is achieved by a cushioned coupling hinge wherein the stop of the hinge to prevent its accidental dislodging from the seat provided inside the seat-ring and the lid, as well as the mechanical engagement to activate the cushioning means, is obtained by means of an engagement element inserted at right angles to the rotation axis of the hinge.

Such object is achieved by a cushioned coupling hinge made in accordance with claim 1. The dependent claims describe preferred or advantageous embodiments of the hinge.

BRIEF DESCRIPTION OF DRAWINGS

The features and advantages of the cushioned coupling hinge according to the present invention will be apparent from the description given below, provided by way of non-limiting example, in accordance with the accompanying figures, wherein.

DETAILED DESCRIPTION

With reference to the accompanying figures, a cushioned coupling hinge for a toilet seat 100 comprising a seat-ring 71 and a lid 72 is indicated collectively at 1.

Figure 1:
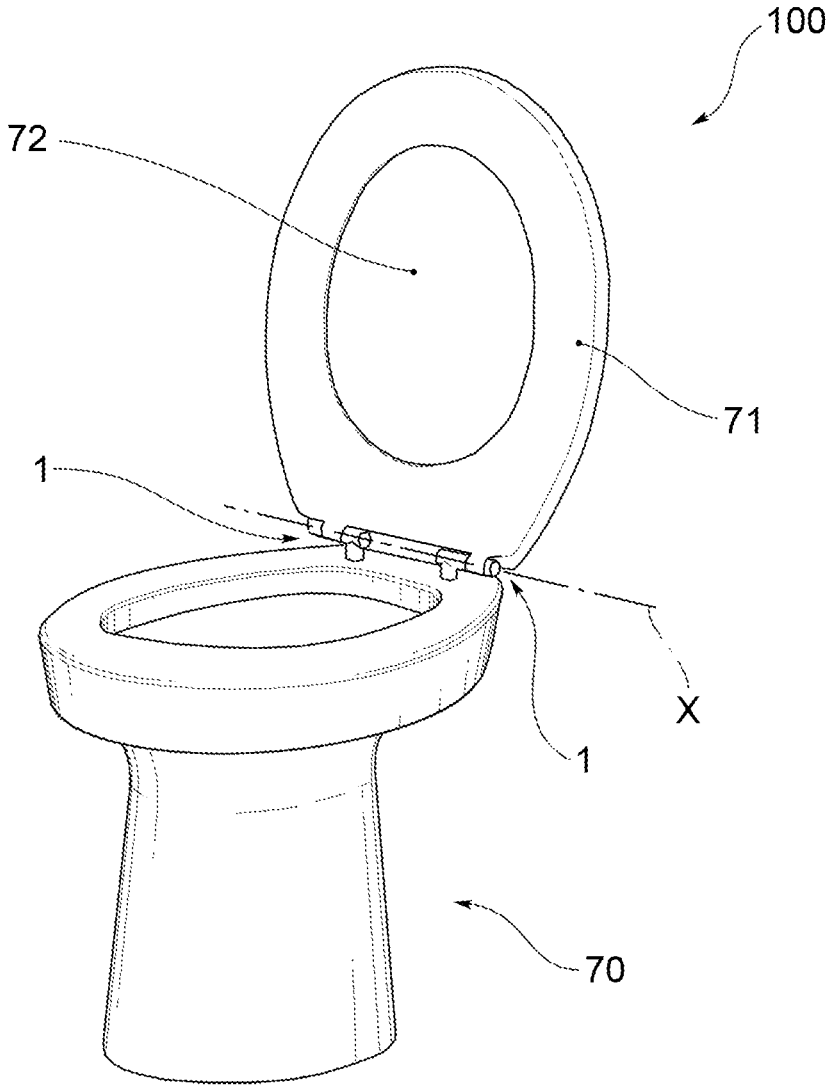
FIG. 1 shows a toilet with a toilet seat, comprising a seat-ring and lid, whereto a coupling hinge is applied according to the present invention.

FIG. 1 shows the application of a pair of hinges 1 to a toilet 70. Each hinge 1 hinges the seat-ring 71 and the related lid 72 to the toilet 70. Being provided with a cushioning mechanism, the hinge 1 cushions the falling motion of the seat-ring 71 or the lid 72 during rotation around the axis of rotation X, easing the downward movement from a substantially vertical opened position to a substantially horizontal closed position, resting on the rim of the toilet 70.

The term "seat-ring" means the annular portion which is employed in using the toilet in the sitting position; the term "lid" means the overlapping element on the seat, suitable to close the toilet.

The term "mobile component" means the component suitable to rotate about the axis of rotation X, i.e., the seat-ring 71 and the lid 72; the term "fixed component" means the component intended not to rotate, i.e. the toilet 70.

Figure 2:
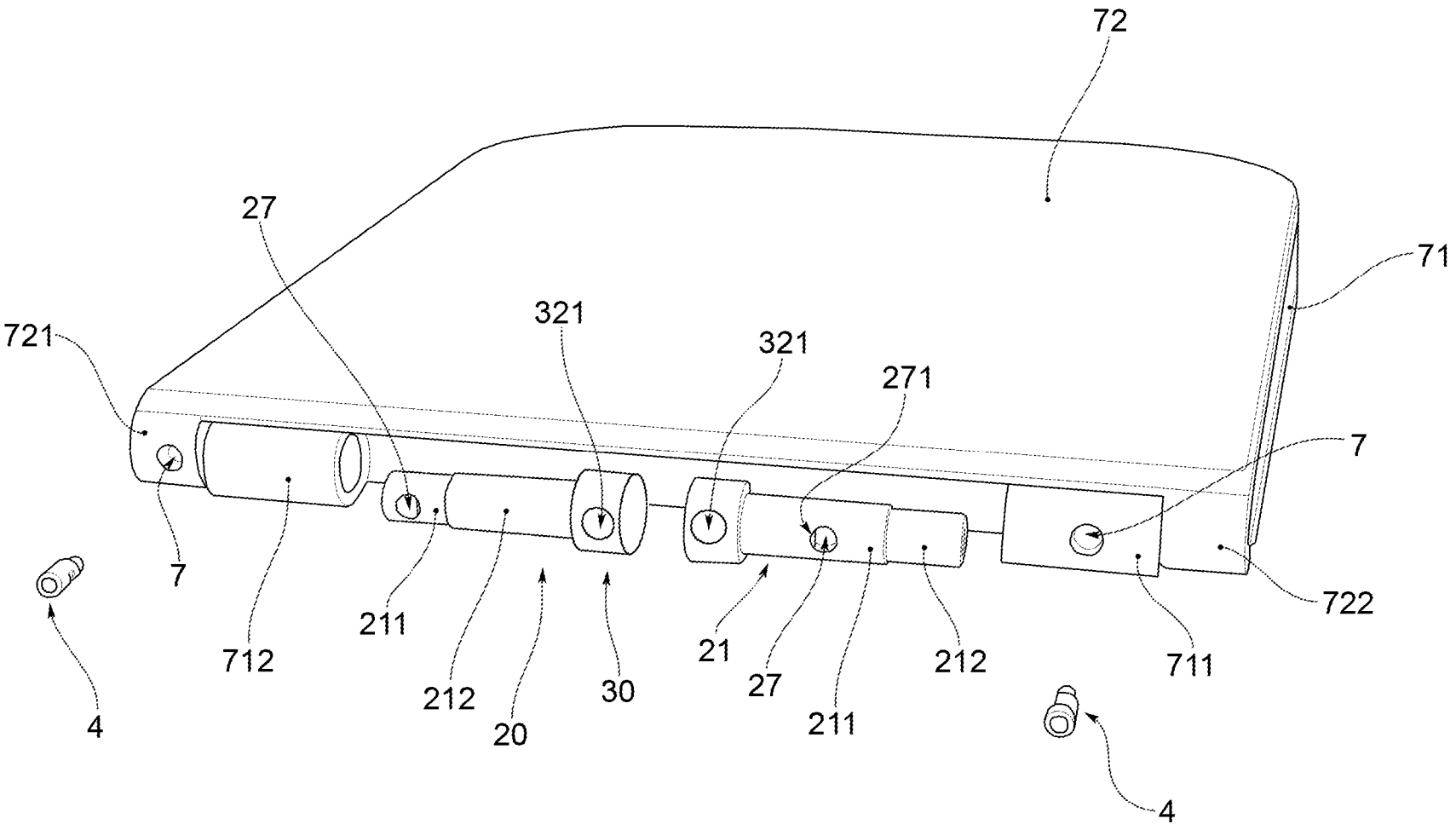
FIG. 2 shows a toilet seat comprising a seat-ring and lid, whereto a coupling hinge is applied according to the present invention.

As shown in FIG. 2, the hinge 1 comprises:

- a mobile portion 20, adapted to be constrained integrally in rotation to a mobile component to be cushioned so as to rotate therewith with respect to an axis of rotation X;
- a fixed portion 30, suitable to be integrally constrained to a fixed component.

The mobile portion 20 and the fixed portion 30 are connected to each other axially along the axis of rotation X. There are no rotational constraints between the mobile portion 20 and the fixed portion 30, that is, each of the two portions 20, 30 is free to rotate around the axis of rotation X.

The mobile portion 20 and the fixed portion 30 are connected to each other with a male-female coupling.

Figure 4:
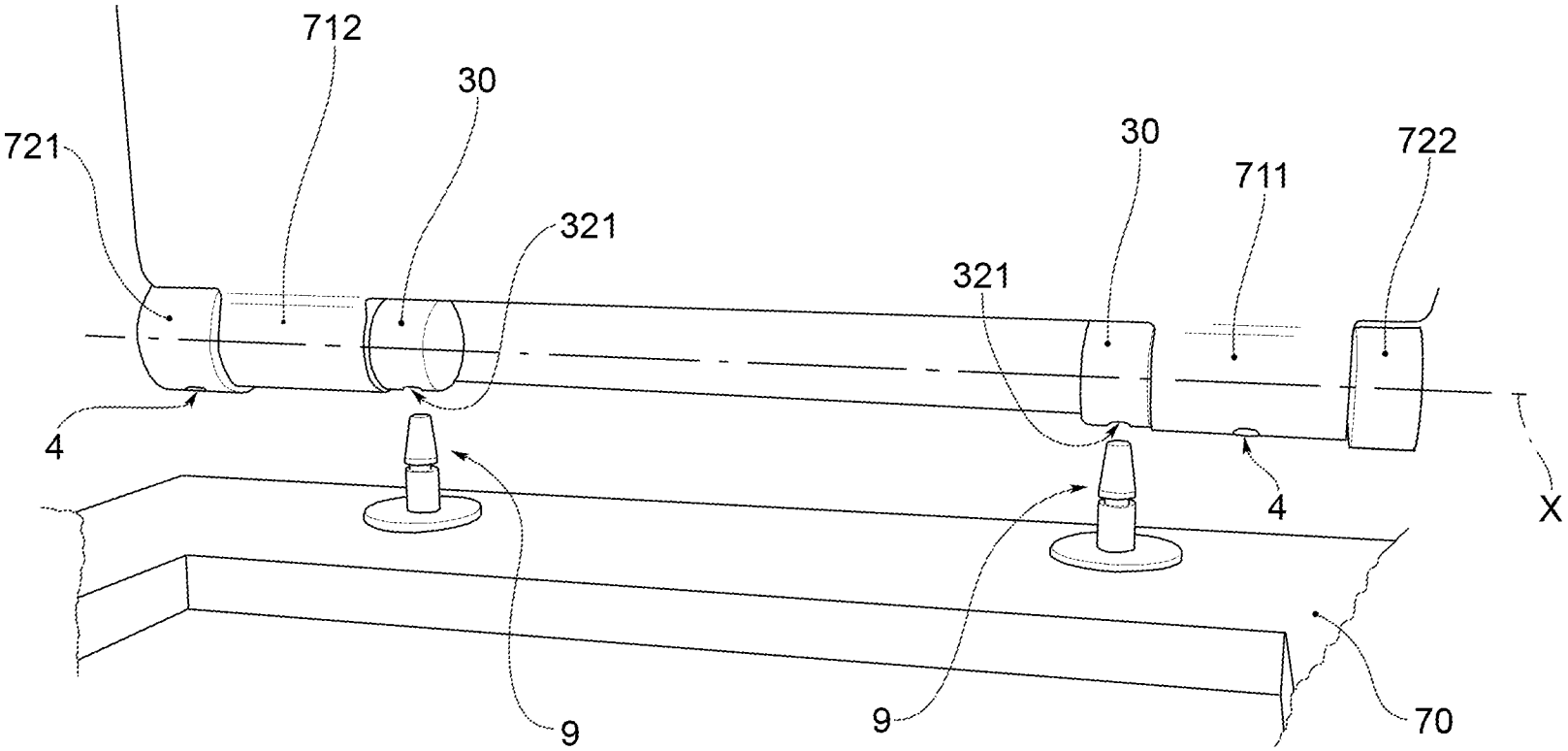
FIG. 4 shows a toilet whereto a toilet seat is applied by means of a quick release system associated with the coupling hinge according to the present invention.

In the hinge 1, only the mobile portion 20 forms the axis of rotation X for the toilet seat, i.e. for the lid and for the seat-ring. In fact, as shown in FIG. 4, only the mobile portion 20 is insertable into the relevant seats 711, 712, 721, 722 provided in the seat-ring 71 and in the lid 72, while the fixed portion 30 remains completely outside. Therefore, in the hinge 1, the lid and the seat-ring rotate supported only by the mobile portion 20.

The mobile portion 20 of the hinge 1 comprises an engagement part 211, suitable to provide the integral constraint in rotation with the mobile component to be cushioned (e.g. the lid 72), and a support member 212, suitable to connect longitudinally, without rotational constraints, with the other mobile component (e.g. the seat-ring 71).

As shown in FIG. 2, the mobile portion 20 is therefore insertable simultaneously in both a relevant seat 711, 712 provided in the seat-ring 71 and in a relevant seat 721, 722 provided in the lid 72.

A seat 711, 712, 721, 722 is a hole made in the seat-ring 71 or lid 72 coaxial with the axis of rotation X. All the seats 711, 712, 721, 722 made in the lid and in the seat-ring are cylindrical (i.e. without teeth) so as to allow the free rotation of the lid and of the seat-ring around the hinge 1, and in particular the mobile portion 20. As the hole forming the seat 711, 712, 721, 722 is cylindrical and without teeth, the molding of the cover and the seat-ring is greatly simplified.

The mechanical engagement (or coupling) between the hinge 1 and the respective mobile component to be cushioned (i.e. the seat-ring 71 or the lid 72) is achieved by means of an engagement element 4 inserted in a direction of engagement Y at right angles to the axis of rotation X, simultaneously through the hinge 1 and the mobile component to be cushioned.

In fact, at least one (indicated at the number 721) of the seats 721, 722 made in the lid 72 and at least one (indicated at the number 711) of the seats 711, 712 made in the seat-ring 71 is provided with an engagement hole 7 at right angles to the axis of rotation X, suitable to house the engagement element 4.

The hinge 1 is also provided with an engagement hole 27, at right angles to the axis of rotation X, at the engagement part 211 of the mobile portion 20, suitable to house the engagement element 4.

Therefore, inserting the engagement element 4 simultaneously into the engagement hole 7 of the seat 721 of the lid 72 (or the seat 711 of the seat-ring 71), and in the engagement hole 27 of the hinge 1, the mechanical engagement for actuating the cushioning mechanism contained in the same hinge is obtained, as well as the stop of the hinge to prevent the accidental dislodging thereof from the seats 711, 712, 721, 722 provided in the seat-ring and in the lid.

The engagement element 4 is, for example, an elastic pin, or a threaded pin, or a pressure pin, or a shaped pin.

Preferably, the engagement element 4 is removable. Thus, the engagement element 4 is provided with a seat for the insertion of an actuation instrument, such as an Allen wrench, a screwdriver, a key.

Figure 3:
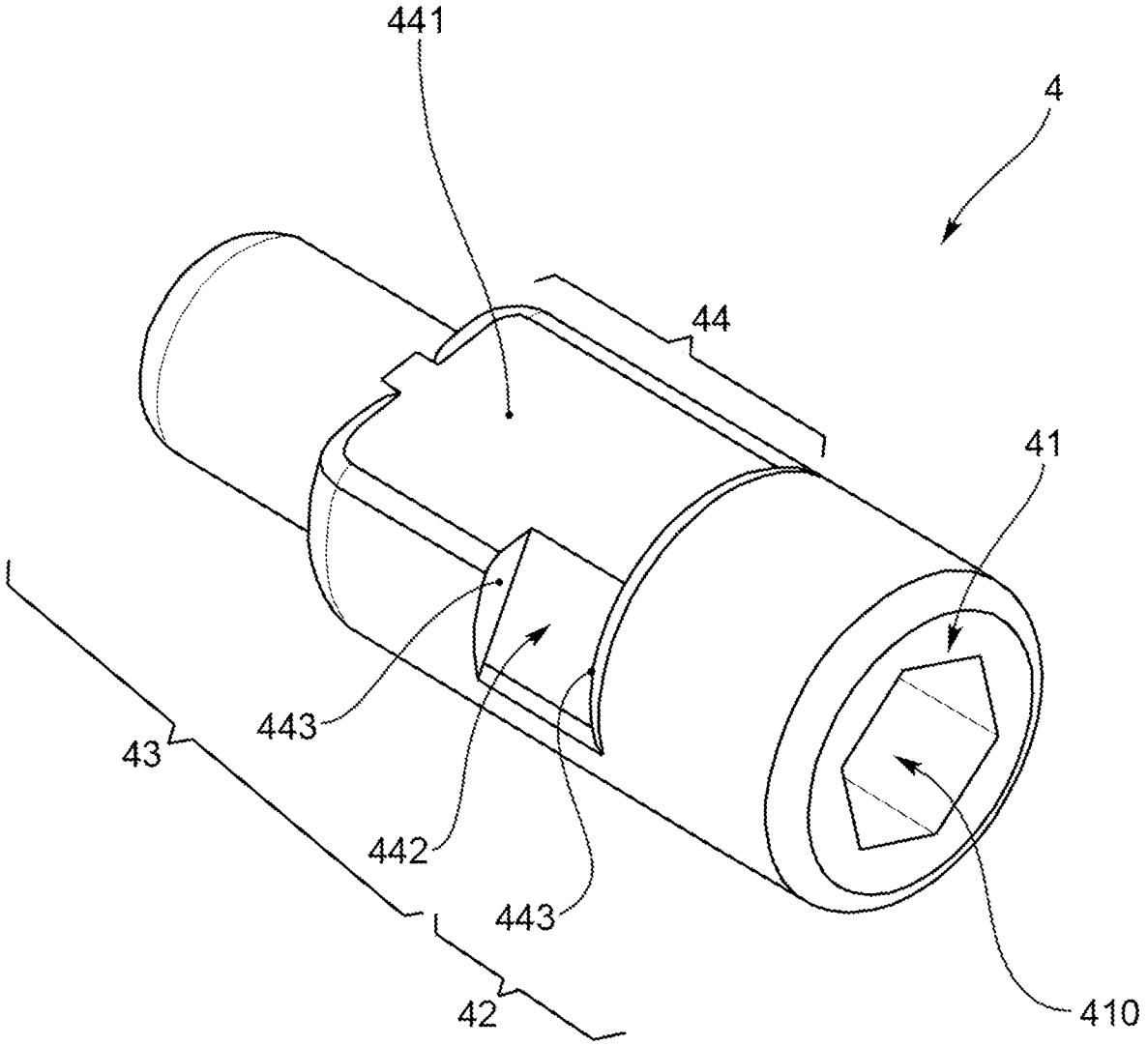
FIG. 3 shows a component of the hinge, and in particular an engagement element in the form of a shaped pin, which acts both as a stop to prevent the hinge from dislodging from the seat provided inside the toilet seat, and as the mechanical engagement to actuate the cushioning means.

In a preferred embodiment, the engagement element is a shaped pin 4 as shown in FIG. 3; in such example, the engagement hole 27 of the hinge 1 is a shaped hole.

The shaped pin 4 comprises, at the rear 41, a seat 410 for the insertion of an actuation instrument.

The shaped pin 4 comprises a rear portion 42 suitable to engage mechanically with the mobile element and thus suitable to be inserted into the engagement hole 7 of the seat 721 of the lid 72 or the seat 711 of the seat-ring 71.

The shaped pin 4 comprises a front portion 43 suitable to engage mechanically with the hinge, and thus suitable to be inserted into the engagement hole 27 of the hinge 1.

The shaped pin 4 comprises, at the front portion 43, a shaped portion 44 suitable to provide, in conjunction with the shaped hole of the hinge, a stop to the exit of the pin to prevent the accidental dislodging of the hinge from the engagement hole 27.

The shaped portion 44 comprises an insertion notch 441 and a locking notch 442. The insertion notch 441 and the locking notch 442 are made on incident planes. The insertion notch 441 and the locking notch 442 are made successively along the outer circumference of the shaped pin 4.

The locking notch 442 comprises a pair of shoulders 443, substantially parallel, arranged at right angles along the pin 4.

The engagement hole 27 of the hinge 1 is a shaped hole, i.e. provided with an abutment 271 protruding into the through opening of the same hole.

Figure 6:
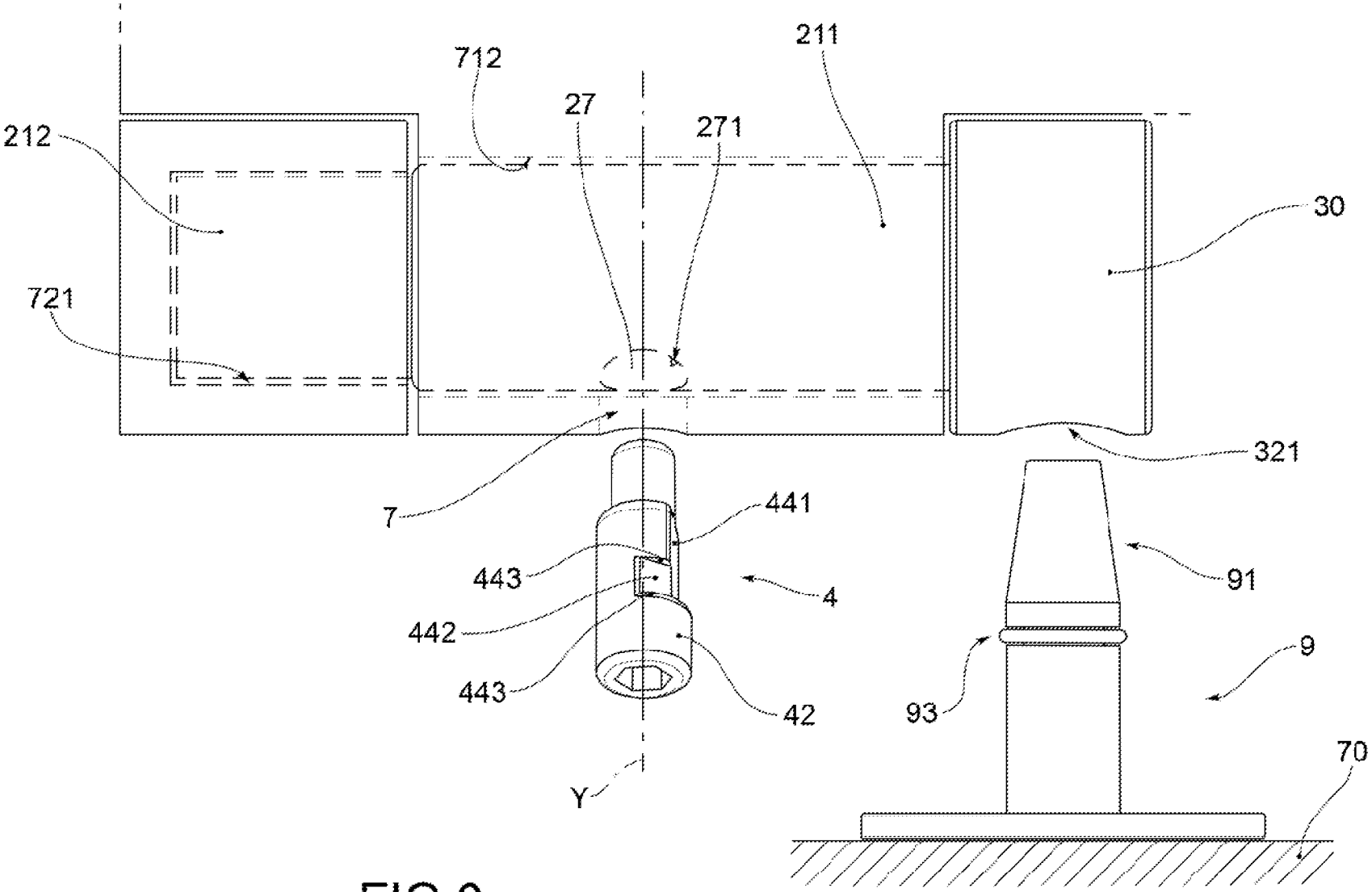
FIG. 6 shows a partly exploded and sectional view of a detail of FIG. 4.
Figure 7:
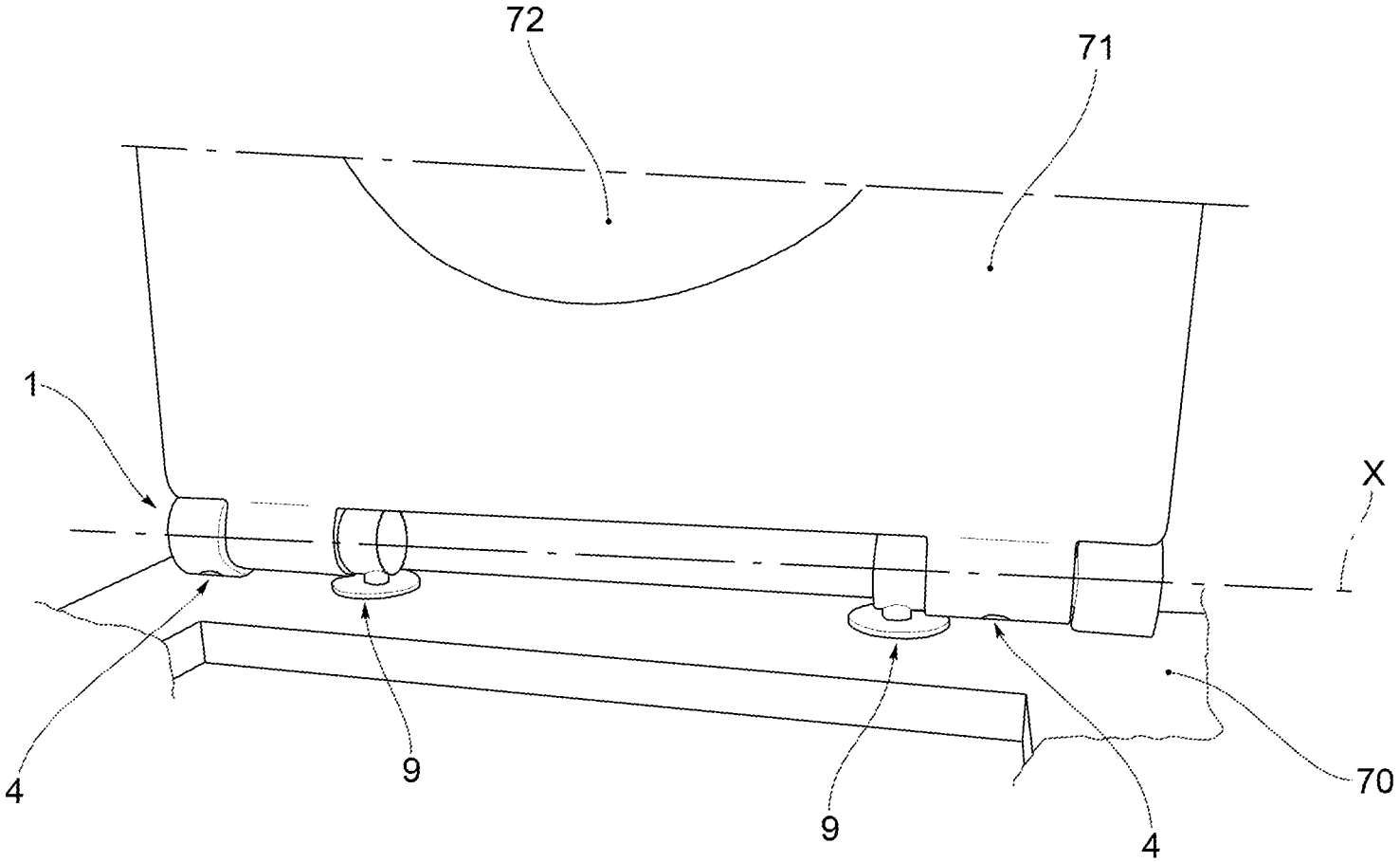
FIG. 7 shows the ceramic of FIG. 4 whereto the toilet seat has been applied.

As shown in FIG. 6, the insertion notch 441, by reducing the cross-section of the pin 4, allows the insertion thereof (along a direction of engagement Y and with the insertion notch 441 facing the abutment 271) through the through opening of the shaped hole 27 of the hinge 1.

The subsequent rotation of the shaped pin 4 (around the engagement axis Y) causes the abutment 271 of the shaped hole to engage the locking notch 442 of the pin 4 and remain locked (along the engagement direction Y) between the shoulders 443, thus stopping the exit of the pin 4 from the engagement hole 27 of the hinge.

Applying a pair of hinges 1, one engaged by means of an engagement element 4 with the seat-ring 71 and the other engaged by means of an engagement element 4 with the lid 72, a toilet 70 is obtained wherein the toilet seat is completely cushioned, i.e. both the seat and the lid are cushioned in the descent stage to be supported on the rim of the bowl.

Figure 5:
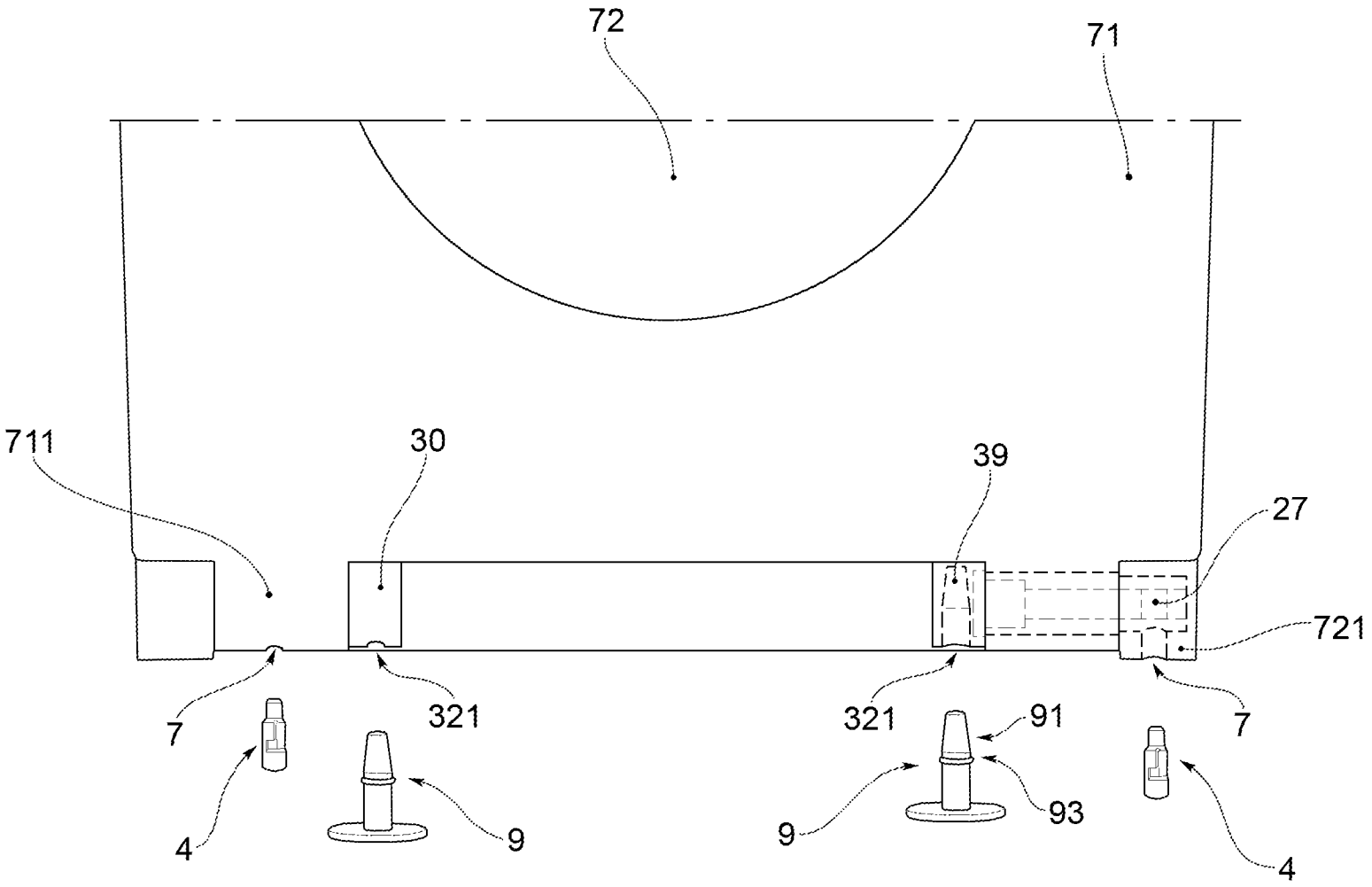
FIG. 5 shows a partly exploded and sectional view of FIG. 4.

As shown in FIGS. 5 and 6, the fixed portion 30 of the hinge 1 comprises an attachment part 32 intended to constrain it integrally with the fixed component, i.e. with the toilet 70. Preferably, the attachment part 32 has an outer diameter larger than the mobile portion 20.

The attachment part 32 is provided with a blind hole 321 for housing an attachment element 9 for coupling between the fixed portion 30 of the hinge 1 and the toilet 70.

The blind hole 321 extends through the attachment part 32 in a direction at right angles to the axis of rotation X. The attachment element 9 is a pin insertable at least partially in the hole 321.

The coupling between the hinge 1 and the toilet 70 is of the quick release type. Advantageously, at least the terminal portion 91 of the pin 9 and at least the distal portion 39 of the hole 321 are conical. The coupling between the pin 9 and the hinge 1 uses the principle of the Morse cone, i.e., a two-piece connection system with a male and female conical shape.

Preferably, the pin 9 also comprises a friction ring, for example metal or rubber, suitable to improve the coupling between the pin 9 and the hinge 1.

The hinge 1 is provided with a cushioning mechanism of the type described in patent number IT1418548 in the name of the holder.

Figure 8:
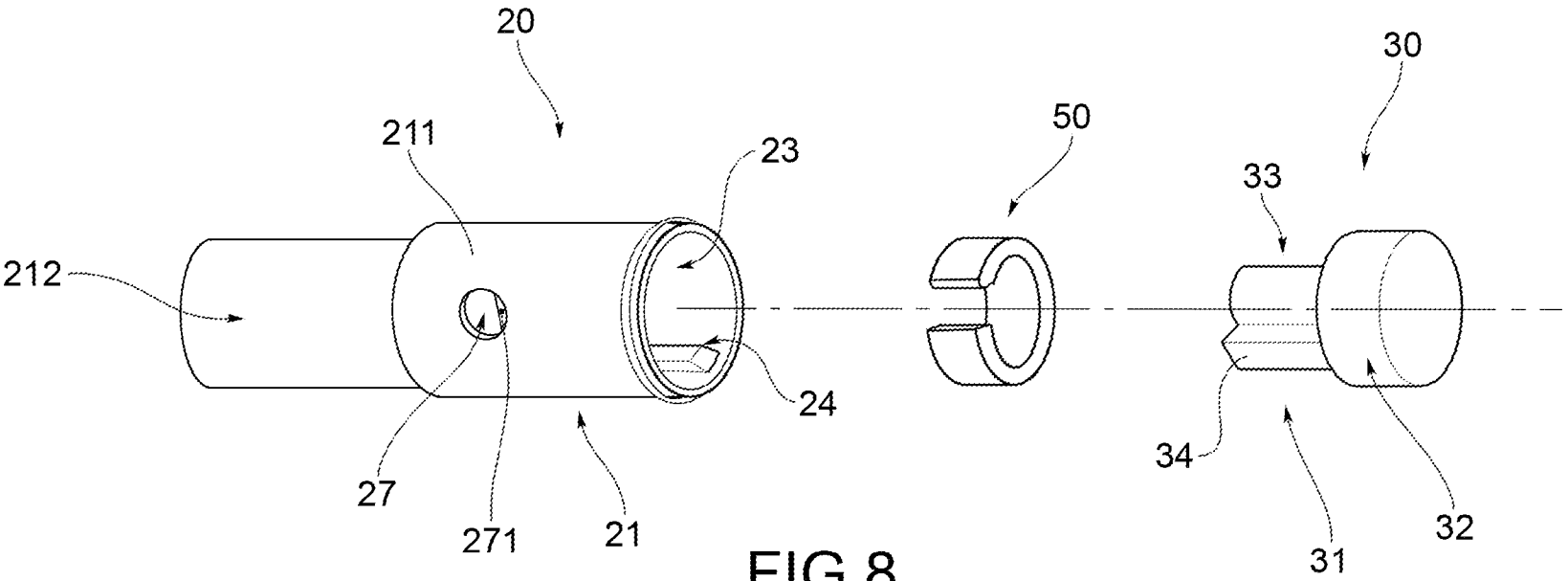
FIG. 8 shows an exploded view of an embodiment of cushioning means for a coupling hinge according to the present invention.
Figure 9:
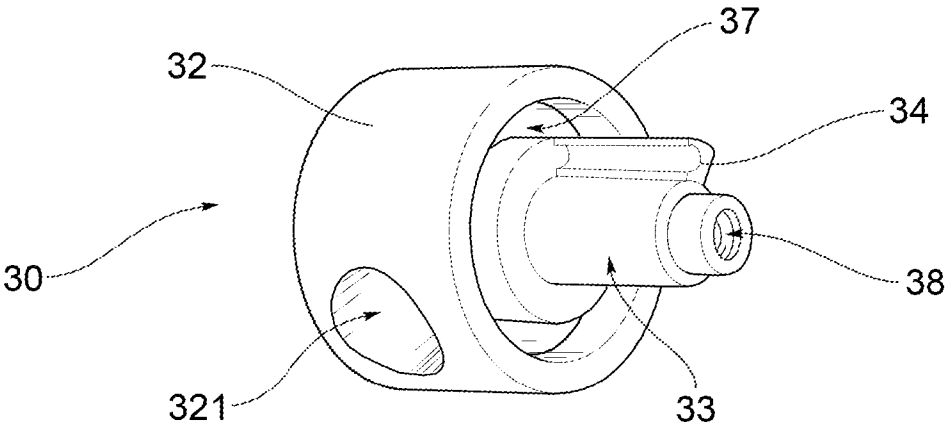
FIG. 9 shows an axonometric view of a detail of FIG. 8.

As shown in FIG. 8, the cushioning mechanism is integrated within the hinge 1 and comprises an elastic element 50 interposed between the mobile portion 20 and the fixed portion 30.

The elastic element 50 is made of resilient material, preferably rubber, for example polyurethane, preferably having a substantially C shape.

The mobile portion 20 comprises a cylindrical body provided with a cylindrical chamber 23 suitable to house the elastic element 50 and, at least partially, the fixed portion 30 therein. Both the body 21 and the chamber 23 extend longitudinally along the axis of rotation X. The body 21 is provided with a tooth 24 protruding from the inner circular wall toward the inside of the chamber 23 in the direction of the axis of rotation X. The body 21 further comprises a non-threaded seat extending longitudinally along the axis of rotation X and suitable to house an attachment element, for example a screw, to attach the mobile portion 20 and the fixed portion 30.

The fixed portion 30 of the hinge 1 comprises a body suitable to be inserted at least partially in the chamber 23 of the mobile portion 20. In particular, the body 31 comprises a braking part 33, intended to be fully inserted into the chamber 23 of the mobile portion 20. The braking part 33 is provided with a tab 34 projecting from the outer circular wall to the outside of the body 31. The body 31, between the braking part 33 and the attachment part 32, comprises a seat 37 suitable to house in abutment the body 21 of the mobile portion 20 when closing the chamber 23 wherein the elastic element 50 is housed. The braking part 33 further comprises a seat 38 extending longitudinally along the axis of rotation X, preferably threaded and suitable to accommodate an attachment element, for example a screw, for attaching the mobile portion 20 and the fixed portion 30.

In use, the rotation of the lid 72 and/or the seat-ring 71 in the direction of closure of the toilet seat causes the rotation of the mobile portion 20 of the hinge around the axis of rotation X. The rotation of the mobile portion 20 causes the tooth 24 to compress the elastic element 50 against the tab 34 of the fixed portion 30, an elastic element 50 which opposes compressive resistance and slows the rotation of the lid 72 and/or the seat 71 in the toilet seat's direction of closure.

The invention therefore relates to a cushioned coupling hinge 1 suitable to rotatably couple the seat-ring 71 and the lid 72 of a toilet seat to a toilet 70. The hinge 1 comprises a cushioning mechanism suitable to cushion the falling movement of the mobile component during rotation around the axis of rotation X, a mobile portion 20 integrally constrainable to the seat-ring or lid in rotation, and a fixed portion 30 integrally constrainable to the toilet 70. Advantageously, both the maintenance in position of the hinge along the axis of rotation and the actuation of the cushioning mechanism is obtained by means of a single engagement element 4 inserted at right angles to the axis of rotation simultaneously through the seat-ring/lid to be cushioned and the mobile portion 20.

The invention also relates to a toilet seat for a toilet, comprising a seat-ring 71 provided with a pair of seats 711, 712 each suitable to at least partially house a cushioned coupling hinge 1; a lid 72 provided with a pair of seats 721, 722, each suitable to at least partially house a cushioned coupling hinge 1; a pair of cushioned coupling hinges 1, each housed at least partially in the respective seat 711, 712, 721, 722 of the lid 72 and of the seat 71. Advantageously, at least one 721 of the seats 721, 722 made in the lid 72 and at least one 711 of seats 711, 712 made in the seat-ring 71 is provided with an engagement hole 7, at right angles to the axis of rotation X, suitable to house the engagement element 4 of the hinge 1 for actuating the cushioning mechanism and maintaining in position the hinge 1 along the axis of rotation X. Advantageously, moreover, the seat 711, 712, 721, 722 of the seat-ring/lid is also a coaxial cylindrical hole with the axis of rotation X, without teeth, to allow the free rotation of the lid 72 and seat-ring 71 around hinge 1.

Innovatively, the cushioned coupling hinge according to the present invention is particularly simple and compact: all the essential elements of the cushioning mechanism are perfectly integrated within the hinge itself, which is a single body with simple handling and installation on the toilet seat.

Advantageously, in the cushioned coupling hinge according to the present invention, both the hinge stop to prevent its accidental dislodging from the seat provided inside the seat-ring and the lid and the mechanical engagement to activate the cushioning means is obtained by means of an engagement element at right angles to the rotation axis of the hinge.

Advantageously, the cushioning coupling hinge according to the present invention allows fastening between the toilet seat and the toilet of the quick-release type in a simple and effective manner, utilizing the principle of the Morse cone.

It is clear that one skilled in the art may make modifications to the above-described device, all contained within the scope of protection as defined by the following claims.

The invention claimed is:

1. Cushioned coupling hinge, suitable to couple in a rotatable manner to a mobile component, namely a seat-ring or lid of a toilet seat, and a fixed component, i.e. a toilet, comprising:

- a cushioning mechanism suitable to cushion the falling movement of the mobile component during rotation about an axis of rotation (X);
- a mobile portion, suitable to be integrally constrained in rotation to the mobile component;
- a fixed portion, suitable to be integrally constrained to the fixed component;

characterized in that both the maintenance in position of the hinge along the axis of rotation (X) and the activation of the cushioning mechanism is obtained by means of an engagement element inserted at right angles to the axis of rotation (X) simultaneously through the mobile component to be cushioned and the mobile portion, wherein the engagement element is a shaped pin insertable in a shaped engagement hole made in the mobile portion, wherein the shaped pin comprises a shaped portion designed to form, in cooperation with the shaped engagement hole, a stop to prevent the accidental dislodging of said pin from the hole, and wherein the shaped portion comprises an insertion notch and a locking notch, made on incident planes and in succession along the outer circumference of the shaped pin.

2. Cushioned coupling hinge according to claim 1, wherein the mobile portion is fitted with an engagement part having an engagement hole, at right angles to the axis of rotation (X), suitable to house the engagement element.

3. Cushioned coupling hinge according to claim 1, wherein the engagement element is removable and has a seat for the insertion of an actuation instrument, such as an Allen wrench, a screwdriver, a key.

4. Cushioned coupling hinge according to claim 1, wherein the locking notch comprises at least one shoulder, placed at right angles to the pin.

5. Cushioned coupling hinge according to claim 1, wherein the shaped engagement hole is fitted with an abutment projecting into the through opening of said hole.

6. Cushioned coupling hinge according to claim 1, wherein the fixed portion comprises an attachment part with a conical hole, suitable to house a pin placed on the fixed component.

7. Cushioned coupling hinge according to claim 6, wherein the coupling with the fixed component is of the quick release type obtained using the principle of the Morse cone by means of a conical pin inserted in the conical hole.

8. Cushioned coupling hinge according to claim 1, wherein the cushioning mechanism comprises an elastic element, made of rubber and substantially C-shaped, interposed between the mobile portion and the fixed portion.

9. Cushioned coupling hinge according to claim 8, wherein:

the mobile portion comprises a chamber, in which the elastic element is housed, and a tooth, projecting inside the chamber;

the fixed portion comprises a braking part, inserted in the chamber, and fitted with a tab projecting outwards;

and wherein the rotation of the mobile portion causes the tooth to compress the elastic element against the tab so that the elastic element, opposing resistance to the compression, slows down the rotation of the mobile element.

10. Cushioned coupling hinge, according to claim 1, wherein the engagement element is an elastic pin, or a threaded pin, or a pressure pin or a shaped pin.

11. Toilet seat for a toilet, comprising:

a seat-ring provided with a pair of seats each suitable to house at least partially a cushioned coupling hinge;

a lid provided with a pair of seats each suitable to house at least partially a cushioned coupling hinge;

a pair of cushioned coupling hinges according to any of the preceding claims, each at least partially housed in the respective seat of the lid and the seat-ring;

wherein at least one of the seats made in the lid and at least one of the seats made in the seat-ring is provided with an engagement hole at right angles to the axis of rotation (X) suitable to house the engagement element of the hinge to activate the cushioning mechanism and the maintenance in place of the hinge along the axis of rotation (X) wherein the engagement element is a shaped pin insertable in a shaped engagement hole made in the lid, wherein the shaped pin comprises a shaped portion designed to form, in cooperation with the shaped engagement hole, a stop to prevent the accidental dislodging of said pin from the hole, and wherein the shaped portion comprises an insertion notch and a locking notch, made on incident planes and in succession along the outer circumference of the shaped pin.

12. Toilet seats for toilets, according to claim 11, wherein the seat is a cylindrical hole coaxial to the axis of rotation (X), with no teeth to allow the free rotation of the lid and the seat-ring around the hinge.

* * * * *